United States Patent [19]

Fraser

[11] Patent Number: 5,009,258

[45] Date of Patent: Apr. 23, 1991

[54] METHOD AND CLIP FOR SECURING A SLAT OF A VENETIAN BLIND

[75] Inventor: Donald E. Fraser, Ramsey, N.J.

[73] Assignee: Hunter Douglas Inc., Upper Saddle River, N.J.

[21] Appl. No.: 281,561

[22] Filed: Dec. 8, 1988

[51] Int. Cl.[5] ..... E06B 9/36

[52] U.S. Cl. ..... 160/168.1; 160/178.1; 24/555

[58] Field of Search ..... 160/178.3, 178.1, 168.1, 160/176.1, 173, 177; 24/562, 555, 545

[56] References Cited

U.S. PATENT DOCUMENTS

| | | | |
|---|---|---|---|
| 656,805 | 8/1900 | Bowman | 24/562 |
| 1,637,564 | 8/1927 | Gillette | 24/562 |
| 2,103,394 | 12/1937 | Wade | 160/178.3 X |
| 2,202,752 | 5/1940 | Brenner | 160/178.3 X |
| 2,527,104 | 10/1950 | Schaefer | 160/178.3 |
| 2,532,617 | 12/1950 | Hauser et al. | 160/178.3 |
| 2,536,472 | 1/1951 | Sherwood | 160/173 |
| 2,927,359 | 3/1960 | Thomas | 24/562 |
| 3,916,973 | 11/1975 | Schuppler et al. | 160/178.3 |
| 3,918,513 | 11/1975 | Englund et al. | 160/176.1 |

FOREIGN PATENT DOCUMENTS

| | | | |
|---|---|---|---|
| 305062 | 10/1968 | Sweden | 160/178.3 |
| 317484 | 11/1969 | Sweden | 160/178.3 |
| 22420 | of 1894 | United Kingdom | 24/562 |

*Primary Examiner*—David M. Purol

*Attorney, Agent, or Firm*—Pennie & Edmonds

[57] ABSTRACT

A method and a clip for securing a slat of a venetian blind to its supporting ladder cord rungs, thereby preventing the slat so secured from not following the remaining slats when they are tilted.

4 Claims, 2 Drawing Sheets

METHOD AND CLIP FOR SECURING A SLAT OF A VENETIAN BLIND

BACKGROUND OF THE INVENTION

The invention relates to venetian blinds, and more particularly to a clip for securing the top slat of a venetian blind to the supporting rung of its ladder cord.

Venetian blinds in general have two sets of cords for operating the blind. A raising/lowering cord raises and lowers the entire blind over the window A ladder cord supports the slats of the blind and controls the opening and closing of the blind by tilting the slats. The ladder cord is generally shaped like a ladder, having rungs and legs. The slats rest freely on the rungs and are tilted when the legs of the ladder cord are raised or lowered by the tilt mechanism.

This arrangement provides a pleasing aesthetic appearance and good control of the slats of the blind, except for the top-most slat. When a one inch supporting rail is used in the construction of a venetian blind with one inch slats, the top-most slat is pinched between the legs of the ladder cord. This pinching is caused by the angle the ladder cord must assume as it extends from the tilt mechanism down and around the top-most slat. This pinching effect prevents the top-most slat from resting freely on the rungs of the ladder cords and therefore when the legs of the ladder cord are raised and lowered by the tilt mechanism the top-most slat is caught between the legs and does not tilt with the rest of the slats. This creates an undesirable and non-uniform appearance in the blind.

It is known in the art that a solution to this problem is to fix the top-most slat to its rungs of the ladder cords. A variety of means have been developed to accomplish this result, but each of these has required a compromise of cost, ease of assembly or aesthetic appearance. One solution has been to provide a separate metal or plastic part which fastens to the underside of the top-most slat in the area of the ladder and rung. The metal part has tabs which are bent around the front and back edges of the slat, with the rung placed between the metal part and the slat, thereby securing the rung and metal part to the top-most slat. The plastic part is similar to the metal part except that it clips around the front and back edges of the slat instead of having tabs which are bent. Installation of these parts requires additional manual steps and mars the aesthetic of the blind.

A second solution to the problem is more aesthetically pleasing, but also more difficult to assemble. In this solution a split rung is provided for the top-most slat. The slat is then passed through the split rung, effectively securing it to the rung.

It is therefore an object of this invention to provide a means for securing the top-most slat of a venetian blind to its rungs on the ladder cords with minimal additional cost and without marring the aesthetic appearance of the blind.

SUMMARY

Accordingly, there is provided a clip having narrowly spaced prongs, equipped with barbs. The barbs grip the surface of the blind slat, preventing it from slipping off. The clip is placed over the rung of each ladder cord supporting the top-most slat, but only along the back edge of the slat in order not to disrupt the aesthetic appearance of the blind from the front.

DETAILED DESCRIPTION OF THE INVENTION

Figure 1:
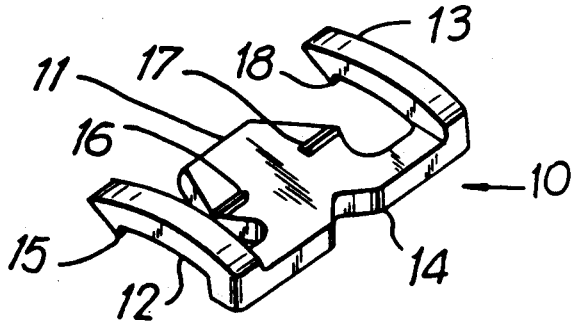
FIG. 1 shows a perspective view of a clip according to a preferred embodiment of the present invention.
Figure 2:
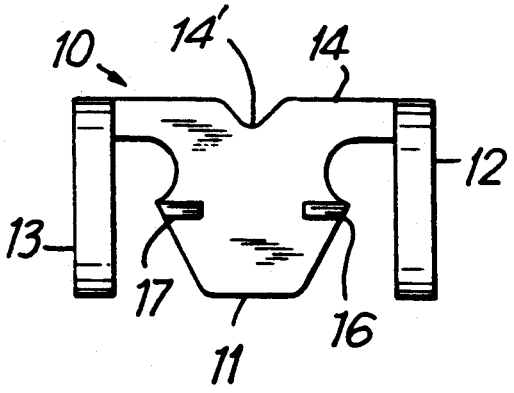
FIG. 2 shows a top view of the clip of FIG. 1.
Figure 3:
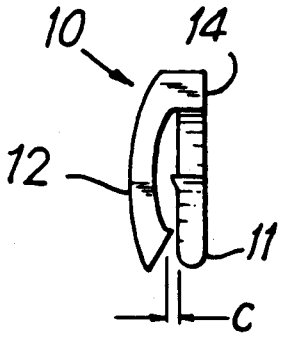
FIG. 3 shows a side view of the clip of FIG. 1.

Referring to FIGS. 1, 2 and 3, in a preferred embodiment of the invention the clip 10 is provided with three prongs 11, 12, 13 extending from a body portion 14. The prongs 11, 12, 13 are provided with barbs 15, 16, 17, 18 which grip the slat of a venetian blind. For this purpose, the slat can be made of rigid fabric. Alternatively, the slats can be made with at least one non-smooth, corrugated, embossed, notched or otherwise roughened surface by itself or through material (e.g., fabric) forming part of laminate materials from which the slat is made. The clearance (c) between the lower prong 11 and upper prongs 12, 13 is sufficient to allow it to be easily pressed on to the slat while staying securely in position once assembled.

In the specific construction of the clip, the body portion 14 is flat and rectangular and has two ends, top and bottom surfaces, and front and back sides. The first prong 11 is integrally formed with and extends from the front side of the body portion 14 and has a top surface coplanar with the top surface of the body portion. The body portion and the first prong generally form a T-shape. The second and third prongs 12 and 13 are integrally formed with the body portion, one at each end thereof. These prongs extend from the top surface of the body portion in the same direction as the first prong 11 and lie in a plane extending generally parallel with and slightly above the top surfaces of the body portion and the first prong 11. The clip is sized for adequate strength and appropriate appearance. In this regard it will be realized from FIG. 3 that the prongs 12 and 13 actually have a curved shape complimentary to the cross-sectional shape of the slats for good fitting and easy assembly Also, the body portion 14 of the clip includes a notch 14' facing in a direction opposite the direction of the prongs. This notch neatly receives the side leg 22' of the ladder cord when the clip is secured to the back edge of the slat.

The clip as shown in FIGS. 1-3 is generally about one-half inch wide and three-fourth inch long, with an overall height of about two-tenths of an inch. This size clip is designed for use with a fabric slat of about one inch in width, but is also suitable for use on a two inch slat.

Figure 4:
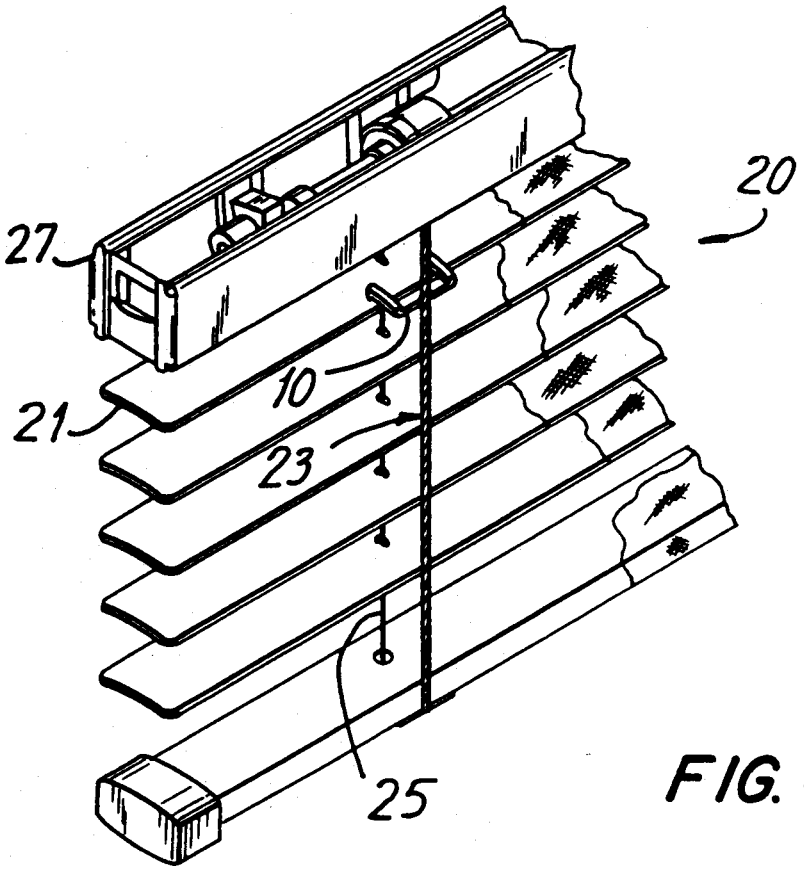
FIG. 4 shows a partial perspective view of the back of venetian blind employing the clip as in FIG. 1.
Figure 5:
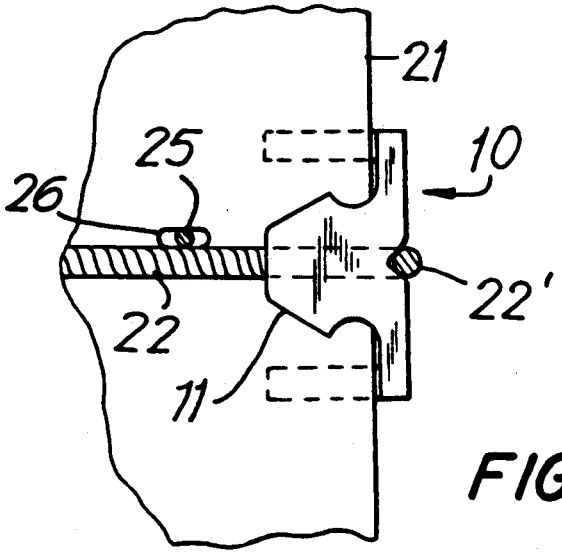
FIG. 5 shows a bottom view of a clip securing a slat to its supporting rung.

FIG. 4 shows the clip 10 in place, securing the top-most slat 21 of a venetian blind 20 to a cross rung 22 of the ladder cord 23. Also shown are the supporting rail 27, bottom rail 28 and lift cord 25. The rung 22 is obscured by the clip 10 in this view. In FIG. 5 it can be seen how the rung 22 runs under the prong 11 of the clip 10 and is secured to the slat 21. The lift cord 25 and the associated slot 26 through the slat 21 are also shown.

The clip used not need not have the exact configuration as the preferred embodiment shown here in FIGS. 1-3. A variety of configurations can be used, including, a clip with only two prongs applied at an angle relative to the edge of the slat 21, so long as it secures the slat 21 to the ladder rung 22 and has the desired appearance.

What is claimed is:

1. A Venetian blind and clip for securing a slat of said blind, comprising in combination:

a ladder cord having vertically extending side legs connected by cross rungs;

at least one slat supported by said cross rungs of said ladder cord;

a raising/lowering cord extending vertically and running through an aperture defined in said slat; and a press-on clip securable on a single edge of the slat for securing the slat to its supporting rung, said clip comprising a first generally planar prong, and second and third prongs formed integrally with and opposed to said first prong, said second and third prongs being spaced from said first prong in order to receive a slat therebetween, said second and third prongs being spaced from one another on either side of said first prong, whereby when said fastener is urged over a slat resting on a cross rung of a ladder of a Venetian blind said second and third prongs cause said first prong to urge the cross rung into frictional engagement with the under side of the slat.

2. The clip of claim 1 wherein each of said second and third prongs comprises a barb for engaging said slat.

3. The clip of claim 1 wherein the prongs extend from a body portion and the length of the first prong from the body portion is chosen to be less than half the width of a predetermined slat, whereby the first prong does not interfere with the raising/lowering cord of the blind.

4. The Venetian Blind and clip of claim 1, wherein said at least one slat has a generally planar surface and said first generally planar prong cooperates with said generally planar surface.

* * * * *